US011125052B2

(12) United States Patent
Watson et al.

(10) Patent No.: US 11,125,052 B2
(45) Date of Patent: Sep. 21, 2021

(54) FRAC VALVE

(71) Applicant: THRU TUBING SOLUTIONS, INC., Oklahoma City, OK (US)

(72) Inventors: Brock W. Watson, Sadler, TX (US); Gregory A. Kliewer, Edmond, OK (US); Brett A. Fears, Mustang, OK (US)

(73) Assignee: Thru Tubing Solutions, Inc., Newcastle, OK (US)

( * ) Notice: Subject to any disclaimer, the term of this patent is extended or adjusted under 35 U.S.C. 154(b) by 78 days.

(21) Appl. No.: 16/416,961

(22) Filed: May 20, 2019

(65) Prior Publication Data

US 2019/0353002 A1 Nov. 21, 2019

Related U.S. Application Data

(60) Provisional application No. 62/674,383, filed on May 21, 2018.

(51) Int. Cl.

| | |
|---|---|
| ***E21B 34/06*** | (2006.01) |
| ***E21B 34/10*** | (2006.01) |
| *E21B 43/14* | (2006.01) |
| *E21B 43/26* | (2006.01) |

(52) U.S. Cl.
CPC ..... *E21B 34/063* (2013.01); *E21B 34/10* (2013.01); *E21B 43/14* (2013.01); *E21B 43/26* (2013.01); *E21B 2200/06* (2020.05)

(58) Field of Classification Search
CPC ..... E21B 2200/06; E21B 33/00; E21B 34/063
See application file for complete search history.

(56) References Cited

U.S. PATENT DOCUMENTS

| | | | |
|---|---|---|---|
| 9,309,746 | B1 | 4/2016 | Watson et al. |
| 2010/0108148 | A1 | 5/2010 | Chen et al. |
| 2013/0056220 | A1 | 3/2013 | Sommers et al. |
| 2013/0168099 | A1 | 7/2013 | Themig |
| 2015/0034324 | A1 | 2/2015 | Norrid |
| 2015/0068757 | A1 | 3/2015 | Hofman et al. |

OTHER PUBLICATIONS

Wellhoefer et al.; "Building a Re-Frac-Ready Completion", Hydraulic Fracturing Journal, vol. 3, No. 1, dated Jan. 2016, 6 pages.
International Search Report with Written Opinion dated Sep. 9, 2019 for PCT Patent Application No. PCT/US2019/033042, 13 pages.

*Primary Examiner* — Kristyn A Hall
(74) *Attorney, Agent, or Firm* — Smith IP Services, P.C.

(57) ABSTRACT

A frac valve can include an outer housing with at least one port which provides for fluid communication between an interior and an exterior of the outer housing, and a sleeve releasably secured against displacement between a closed position in which the sleeve blocks flow through the port and an open position in which flow through the port is permitted. The sleeve may be press-fit in the outer housing as a result of the displacement. A method of operating a frac valve can include connecting the frac valve in a tubular string, and displacing a sleeve of the frac valve between closed and open positions. The displacing step can include deforming the sleeve and/or an outer housing of the frac valve, thereby preventing relative rotation between the sleeve and the outer housing.

27 Claims, 6 Drawing Sheets

FRAC VALVE

CROSS-REFERENCE TO RELATED APPLICATION

This application claims the benefit of the filing date of U.S. provisional application No. 62/674,383 filed 21 May 2018. The entire disclosure of the prior application is hereby incorporated herein for all purposes.

BACKGROUND

A frac valve can be used to selectively control fluid communication between a zone of a subterranean formation and an interior of a tubular string in a well. If multiple zones are penetrated by a wellbore of the well, selected zones can be isolated from elevated pressure applied to the interior of the tubular string (such as, during a fracturing or other treatment operation) by closing corresponding ones of multiple frac valves connected in the tubular string. The frac valves may be in closed configurations when initially installed in the well, and then opened when it is desired to provide fluid communication with the zones corresponding to the opened valves.

Therefore, it will be appreciated that advancements in the arts of constructing and utilizing frac valves are continually needed. Such advancements may be used in multiple zone fracturing operations, or in other well operations.

DETAILED DESCRIPTION

Figure 1:
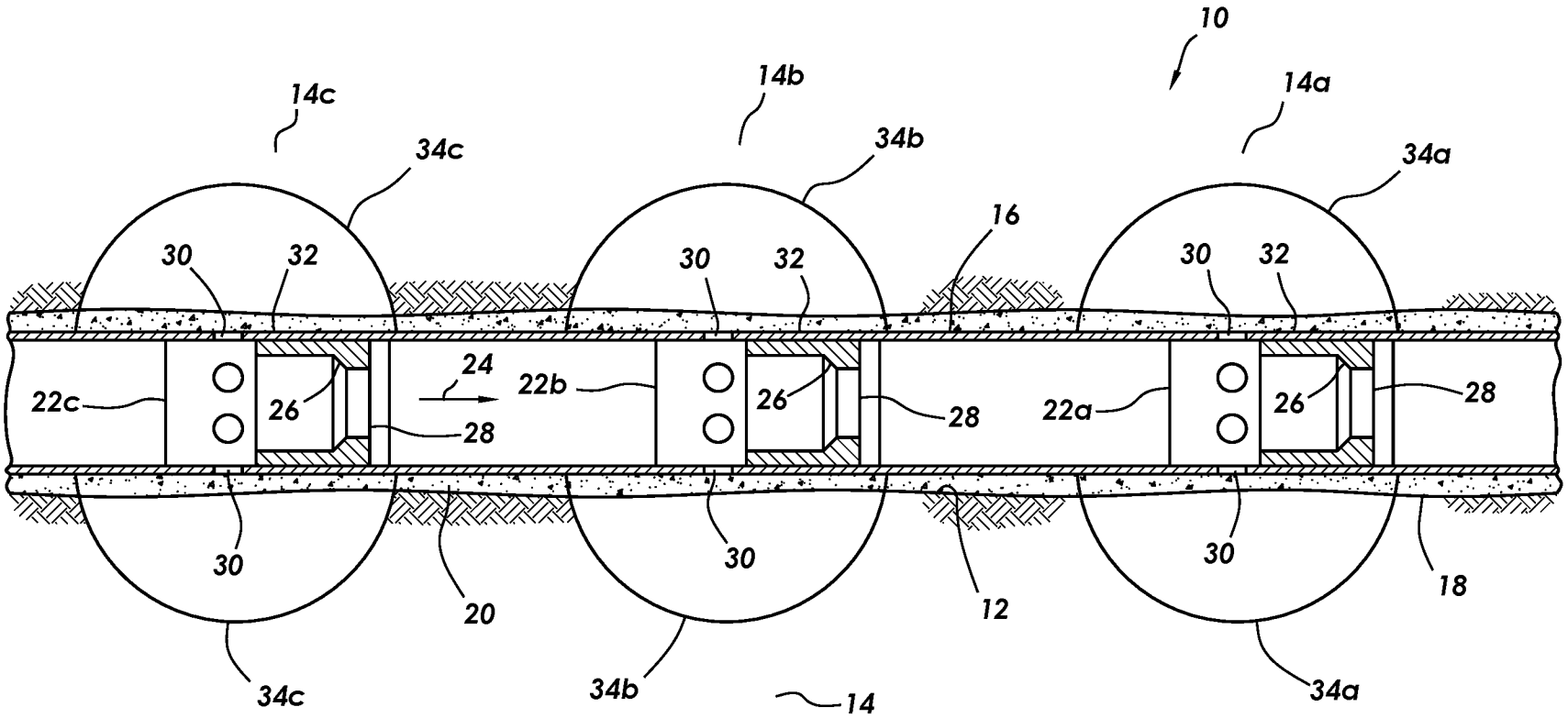
FIG. 1 is a representative cross-sectional view of a system and method that may embody principles of this disclosure.

Representatively illustrated in FIG. 1 is a system 10 for use with a well, and an associated method, which system and method can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a wellbore 12 has been drilled, so that the wellbore penetrates multiple zones 14*a-c* of an earth formation 14. The wellbore 12 is lined with casing 16 and cement 18. As used herein, the term "casing" refers to a protective wellbore lining, and can include tubulars of the types known to those skilled in the art as casing, liner, pipe or tubing, whether jointed or continuous, whether or not expandable downhole, and whether or not formed in situ.

In other examples, external casing packers or other devices (such as, swellable packing) could be used to seal off an annulus 20 external to the casing 16, in order to isolate the zones 14*a-c* from each other in the annulus. The casing 16 may be any type of tubular string, which may be positioned within another tubular string, and may not be cemented in the wellbore 12. The wellbore 12 is generally horizontal as depicted in FIG. 1, but the wellbore could be substantially vertical or deviated in other examples. Although three formation zones 14*a-c* are illustrated in FIG. 1, any number of zones may be used, and it is not necessary for all of the zones to be sections of the same formation 14. Thus, the scope of this disclosure is not limited to any particular details of the wellbore 12, casing 16, cement 18, zones 14*a-c* or other features, characteristics or components as depicted in FIG. 1 or described herein.

Frac valves 22*a-c* are connected in the casing 16 proximate the respective zones 14*a-c*. In other examples, a particular valve may control communication between multiple zones and the interior of the casing 16, or multiple valves may control communication between a single zone and the interior of the casing. Thus, there is not necessarily a one-to-one correspondence between the individual valves and the zones penetrated by a wellbore in other examples.

Initially, all of the valves 22*a-c* are closed in the FIG. 1 example. This facilitates placement of the cement 16 in the annulus 20.

After the cementing operation, and when it is desired to fracture the zone 14*a*, a plug (such as, a ball, a dart, etc., not shown in FIG. 1) can be displaced to the valve 22*a* (for example, by flow of fluid 24 through the casing 16), so that the plug sealingly engages a seat 26 formed in a sleeve 28 of the valve 22*a*. When a sufficient pressure differential is applied across the plug and sleeve 28, the sleeve will shift to an open position, as depicted in FIG. 1.

The fluid 24 can now flow outward through open ports 30 formed through an outer housing 32 of the valve 22*a*. When sufficient pressure and flow of the fluid 24 through the ports 30 is applied, fractures 34*a* are formed in the zone 14*a*. The fluid 24 may convey proppant, acid, conformance agents, gels or other substances into the zone 14*a* via the fractures 34*a*.

The above steps are repeated for each of the other zones 14*b,c* to form fractures 34*b,c* in those zones. Note that, when a plug is sealingly engaged in a sleeve 26, the zone(s) below (further downhole) are isolated from the applied pressure and flow of the fluid 24 above (further uphole) from the plug. And, since any valve(s) above the plug are closed, the applied pressure and flow of the fluid 24 acts on only the zone proximate the valve that is open due to engagement of the plug with the seat of that valve.

After the fracturing operations are concluded, there is a plug engaged with each of the seats 26 of the valves 22*a-c*. In some examples, the plugs can be flowed to surface with production of fluid from the zones 14*a-c*. Typically, however, the plugs and seats 26 are drilled through, to thereby permit production flow from all of the zones 14*a-c*.

Unfortunately, if the sleeves 28 are permitted to rotate in the outer housings 32, it can be difficult, if not impossible, to drill out the plugs and seats 26. In the past, splines, clutches or other complex or costly devices or mechanisms have been used to prevent rotation of sleeves. Even if the devices or mechanisms were effective, they required that multiple-component outer housings be used, or they introduced other expensive or failure-prone complications.

Therefore, it would be beneficial to be able to prevent rotation of the sleeves 28 after the fracturing operation in an effective and economical manner that does not involve any additional expensive or failure-prone complications. This disclosure provides a solution to this problem. However, note that it is not necessary for a frac valve embodying the principles of this disclosure to solve this particular problem, since other problems may be solved by a frac valve in keeping with the principles of this disclosure.

Figure 2:
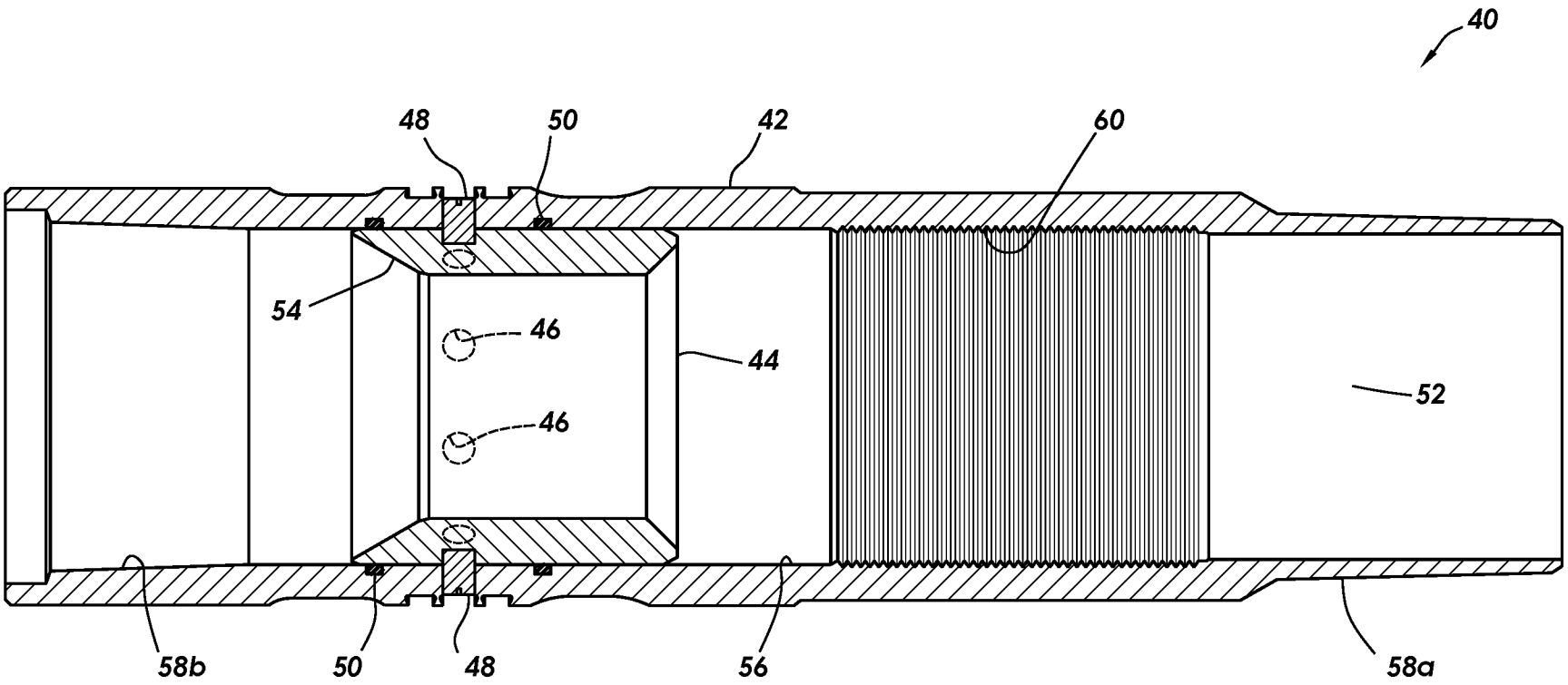
FIG. 2 is a representative cross-sectional view of a frac valve that may be used in the system and method of FIG. 1, and which may embody the principles of this disclosure.

Referring additionally now to FIG. 2, an example of a frac valve 40 is representatively illustrated. The valve 40 may be used for any of the valves 22*a-c* described above in the FIG. 1 system 10 and method, or it may be used in other systems and methods.

In the FIG. 2 example, the valve 40 includes a generally tubular outer housing 42 and an inner generally tubular sleeve 44. As depicted in FIG. 2, the valve 40 is in a closed run-in configuration, in which the sleeve 44 blocks flow through ports 46 formed radially through the outer housing 42.

Shear screws 48 or other releasable members releasably retain the sleeve 44 in its initial closed position. Seals 50 longitudinally straddle the ports 46 and provide for sealing engagement between the outer housing 42 and the sleeve 44, thereby isolating the ports 46 from an interior flow passage 52 of the valve 40. When connected in the casing 16 of FIG. 1, the interior flow passage 52 extends longitudinally through the interior of the casing.

As depicted in FIG. 2, a seat 54 is formed in an upper end of the sleeve 44. The seat 54 can be sealingly engaged by a plug, as described more fully below. In the FIG. 2 example, the seat 54 comprises an upwardly opening frusto-conical surface formed in the sleeve 44, but in other examples the seat could be in the form of a seal bore or other surface that may be sealingly engaged by a ball, dart or other type of plug.

Note that the outer housing 42 in this example is a single component. The sleeve 44 is reciprocably disposed in a bore 56 formed in the housing 42 between end connections 58*a,b* configured for connecting the valve 40 in a tubular string (such as the casing 16 of FIG. 1).

Longitudinally spaced apart from the sleeve 44 is an internal reduced dimension area 60 in the outer housing 42. In this example, the area 60 extends circumferentially about the flow passage 52 and has an inner diameter that is smaller than an outer diameter of the sleeve 44.

However, in other examples, the area 60 could have a reduced dimension that is other than an inner diameter, and it is not necessary for the area to completely circumscribe the flow passage 52. For example, the area could have an oval shape or other non-circular shape having a minor diameter or other minimum lateral dimension that is smaller than the outer diameter of the sleeve 44.

Figure 3:
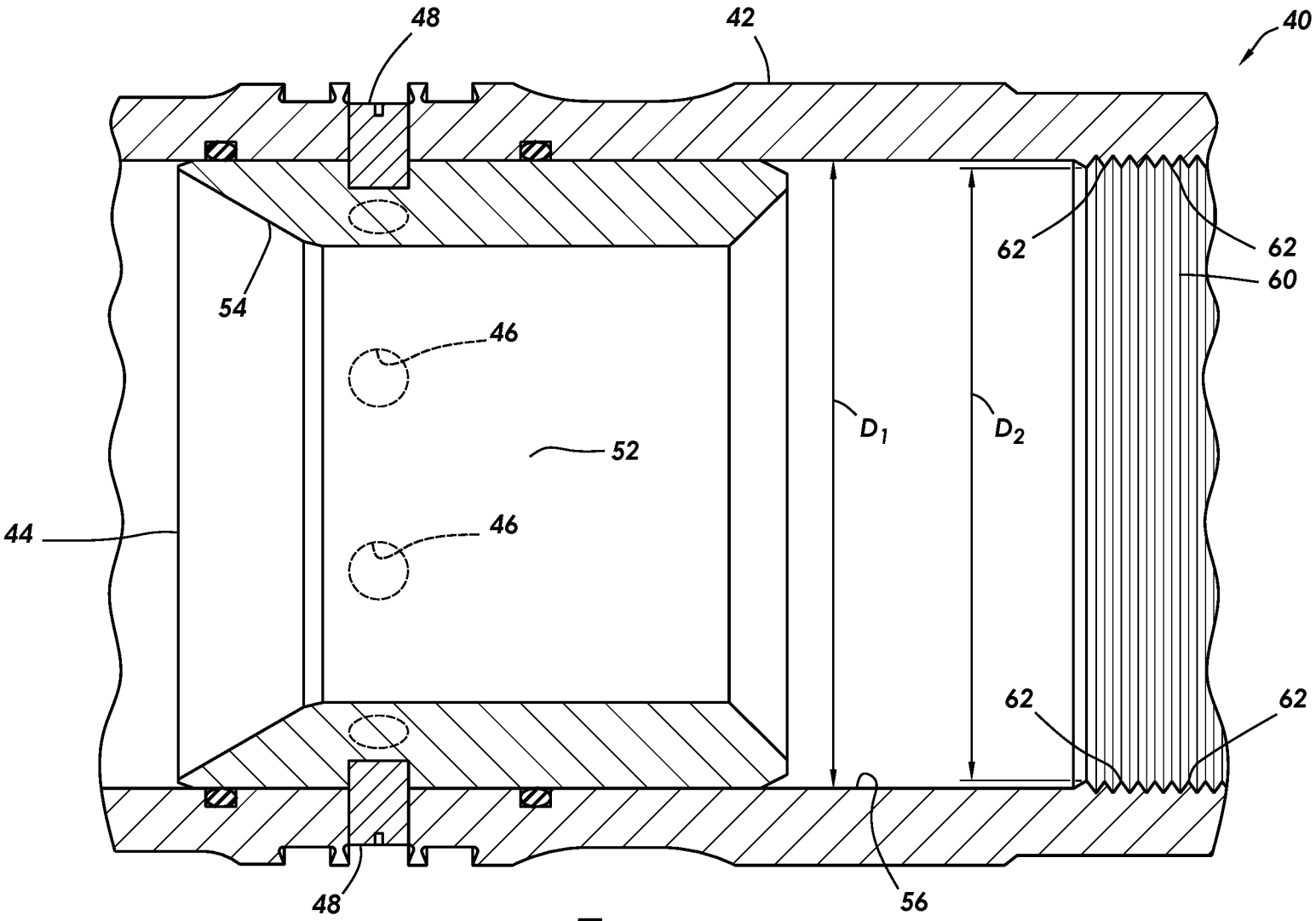
FIG. 3 is a representative cross-sectional view of a section of the FIG. 2 frac valve in a run-in configuration.

Referring additionally now to FIG. 3, a somewhat enlarged scale cross-sectional view of a section of the frac valve 40 is representatively illustrated. In this view, the valve 40 is still in its closed configuration, with the sleeve 44 preventing fluid flow through the ports 46.

In the FIG. 3 example, the sleeve 44 has an outer dimension D1 that is only slightly smaller than a diameter of the bore 56. For example, the outer dimension D1 may be a few thousandths of an inch (e.g., ~0.05 mm) smaller than the bore 56 diameter. In other examples, the bore 56 could have a diameter that is significantly larger than the outer dimension D1 of the sleeve 44.

Since the bore 56 diameter is larger than the outer dimension D1 of the sleeve 44, when a plug is engaged with the seat 54 and a sufficient pressure differential is applied across the plug and sleeve to shear the screws 48, the sleeve can displace downward (to the right as viewed in FIG. 3) without this displacement being obstructed by the bore or any other impediments along the length of the bore. In this manner, the ports 46 will become unblocked, allowing unobstructed flow from the passage 52 to the exterior of the valve 40 (e.g., into the annulus 20 in the FIG. 1 system 10).

Eventually, however, the sleeve 44 will reach the reduced dimension area 60. In the FIG. 3 example, the area 60 includes a series of multiple V-shaped ridges or projections 62 extending radially inward from the outer housing 42 and circumferentially about the flow passage 52. The projections 62 have an inner dimension D2 that is less than the outer dimension D1 of the sleeve 44.

As depicted in FIG. 3, the inner dimension D2 is an inner diameter of the ridges or projections 62. However, it is not necessary that the projections 62 have an inner diameter (for example, the projections may not be circular-shaped in other examples), or that the inner diameter of the projections is less than an outer diameter of the sleeve 44.

The projections 62 in the FIG. 3 example are similar to conventional V-shaped threads, but the projections are not helical. In other examples, the projections 62 could have other shapes.

Figure 4:
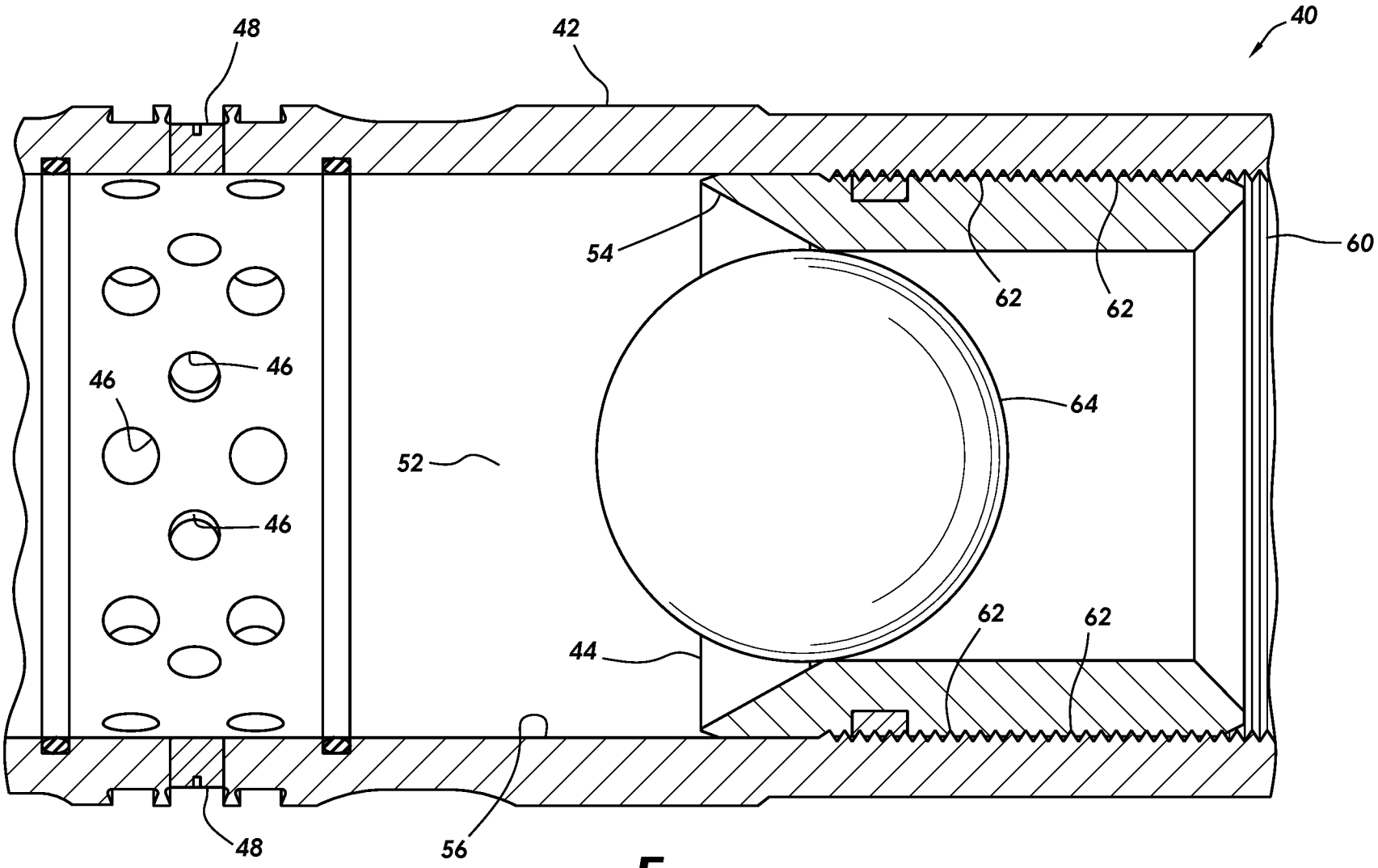
FIG. 4 is a representative cross-sectional view of the section of the frac valve in an actuated configuration.

Referring additionally now to FIG. 4, a cross-sectional view of the valve 40 is representatively illustrated. In this view, a plug 64 has sealingly engaged the seat 54 to thereby prevent downward flow through the passage 52, and a sufficient pressure differential has been applied across the plug and the sleeve 44 to cause the screws 48 to shear.

After the screws 48 shear, the pressure differential will force the sleeve 44 and plug 64 to displace downward (to the right as viewed in FIG. 4). The ports 46 will be unblocked, thereby permitting flow from the passage 52 to the annulus 20 (see FIG. 1) via the ports, as the sleeve 44 displaces through the bore 56.

At the end of the bore 56, the sleeve 44 will engage the reduced dimension area 60. In the FIG. 4 example, the sleeve 44 has entered the area 60, and has deformed many of the projections 62, and/or many of the projections have gripped, deformed or "bitten into" an exterior of the sleeve. This engagement between the sleeve 44 and the projections 62 not only eventually stops the downward displacement of the sleeve 44, it also causes the sleeve to be so tightly received in the area 60 that it is prevented from rotating relative to the outer housing 42 (for example, during operations to drill out the sleeve).

Materials, dimensions and other characteristics of the sleeve 44, the outer housing 42 and the projections 62 can be selected so that any of a variety of different results are produced when the sleeve engages the area 60. For example, the projections 62 may elastically or plastically deform, the sleeve 44 may elastically and/or plastically deform, and/or the outer housing 42 may elastically and/or plastically deform. In any event, the engagement between the sleeve 44 and the area 60 produces sufficient friction between them that relative rotation between the sleeve and the outer housing 42 is prevented.

Figure 5:
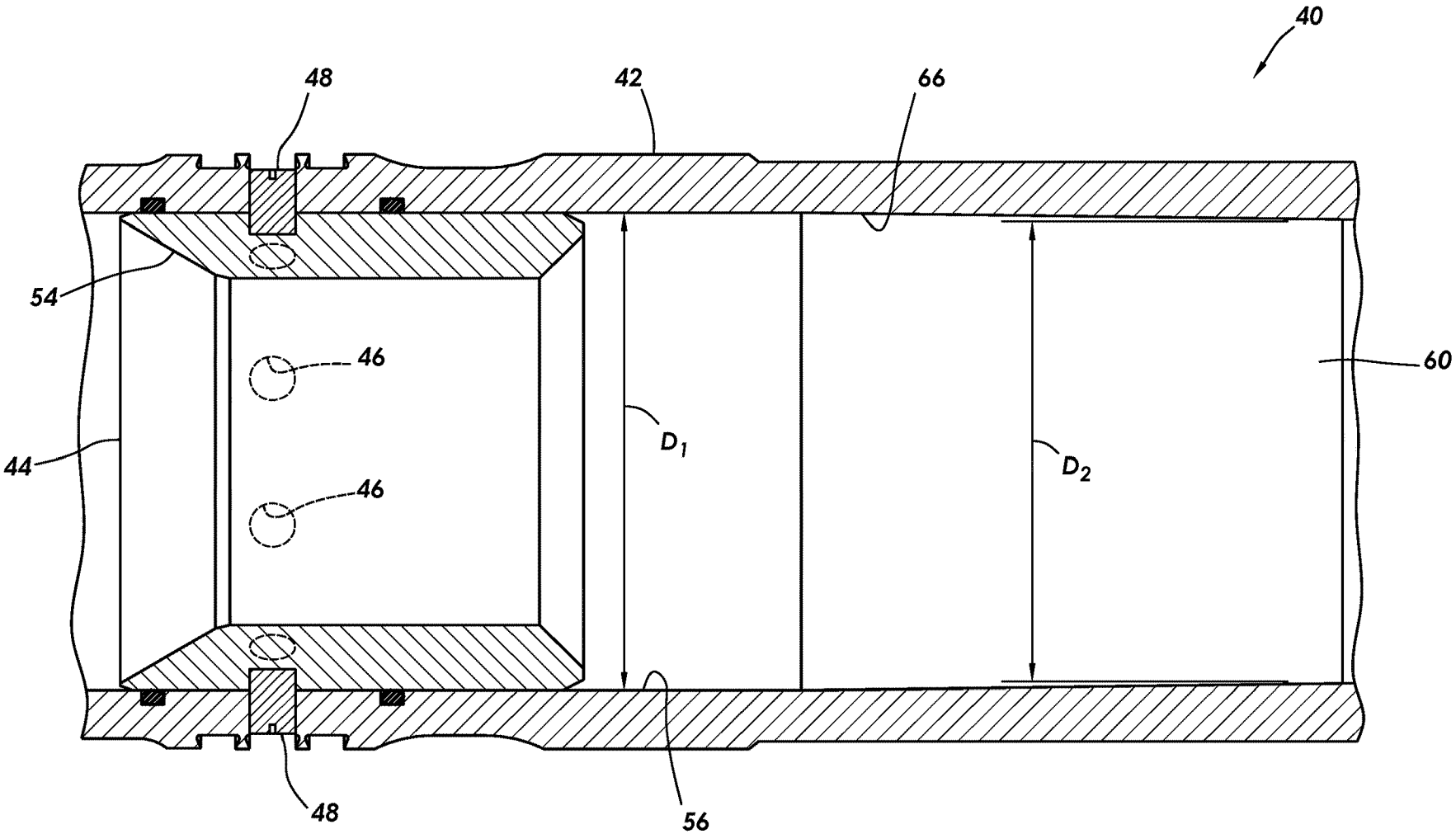
FIG. 5 is a representative cross-sectional view of another example of the frac valve.

Referring additionally to FIG. 5, another example of the valve 40 is representatively illustrated. In this example, the area 60 does not include the projections 62, but instead includes an internal taper 66 in the form of an upwardly opening frusto-conical surface.

The taper 66 begins at a downward end of the bore 56, and has the reduced inner dimension D2 at a downward end of the taper. An inner diameter of the taper 66 decreases in the downward direction of displacement of the sleeve 44.

When the sleeve 44 displaces downward and engages the taper 66, the sleeve will become tightly "wedged" or press-fit into the taper. This will result in a large amount of friction between the sleeve 44 and the taper 66, thereby preventing relative rotation between the sleeve and the outer housing 42.

Materials, dimensions and other characteristics of the sleeve 44, the outer housing 42 and the taper 66 can be selected so that any of a variety of different results are produced when the sleeve engages the area 60. For example, the sleeve 44 may elastically and/or plastically deform, and/or the outer housing 42 may elastically and/or plastically deform. In any event, the engagement between the sleeve 44 and the area 60 produces sufficient friction between them that rotation of the sleeve in the outer housing 42 is prevented.

Figure 6:
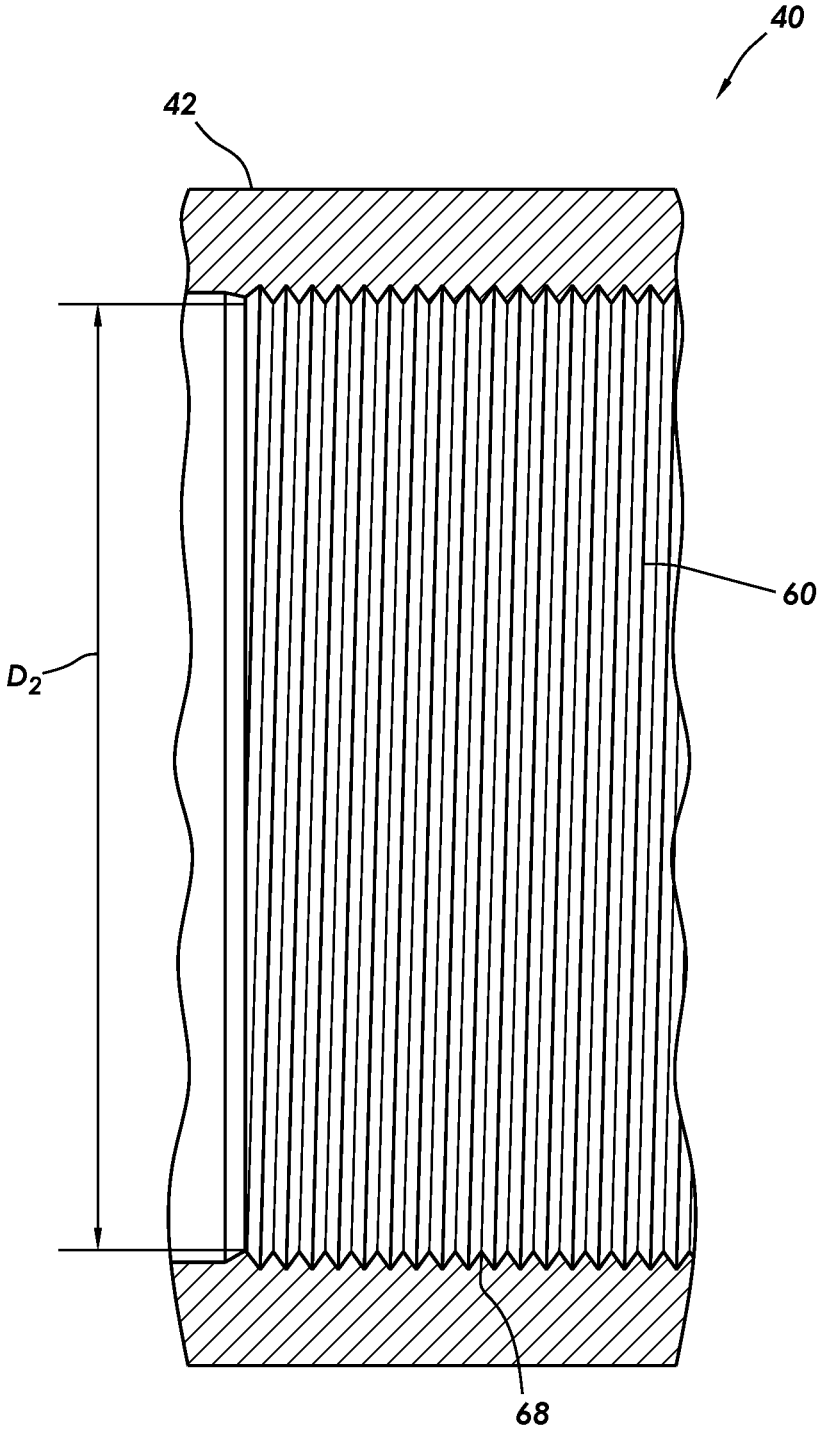
FIG. 6 is a representative cross-sectional view of an internally threaded area of the frac valve.

Referring additionally now to FIG. 6, another example of the area 60 is representatively illustrated. In this example, the area 60 has threads 68 formed therein.

The threads 68 have a minor diameter of D2, which is less than the outer dimension D1 of the sleeve 44. Thus, when the sleeve 44 engages the threads 68, the sleeve will be tightly wedged or press-fit therein, thereby preventing rotation of the sleeve relative to the outer housing 42.

In addition, since the threads 68 are helical in form, any induced rotation of the sleeve 44 relative to the outer housing 42 (such as, during a drilling-out operation) will cause the sleeve to be further engaged in the threads, thereby enhancing the friction between the sleeve and the threads. The threads 68 could be internally tapered (as in the FIG. 5 example) to further increase this friction-enhancing effect.

The threads 68 in the FIG. 6 example are V-shaped. In other examples, the threads 68 could have other shapes (such as, buttress-shaped). Similarly, the projections 62 in the FIGS. 2-4 example could have buttress or other shapes.

In any of the above examples, after the sleeve 44 has been displaced to its open position and a formation zone external to the valve 40 has been fractured (e.g., as in the FIG. 1 system 10), the ports 46 may be plugged by plugging devices. For example, any of the plugging devices described in U.S. Pat. Nos. 9,551,204, 9,523,267, 9,567,824, 9,567,825, 9,567,826, 9,708,883, 9,745,820 and 9,816,341, and US application publication nos. 2016/0348466, 2017/0275965 and 2017/0260828, may be used to plug the ports 46.

The entire disclosures of these US patents and publications are incorporated herein in their entireties. The above-listed US patents and publications describe plugging devices with fibers, lines, ropes, yarns, fabrics, tubes, films or other appendages extending outwardly from at least one enlarged body, the body being too large to pass through a well opening (such as the openings 30 in the FIG. 1 system 10, or ports 46 in the FIGS. 2-5 examples).

It may now be fully appreciated that the above disclosure provides significant advancements to the arts of designing, constructing and utilizing frac valves for use with subterranean wells. In examples described above, the outer housing 42 can be a single component, but can be provided with features (such as, the projections 62, taper 66 or threads 68) to prevent rotation of the sleeve 44 when the valve 40 is in its open configuration.

Some beneficial optional features of the above disclosure, which may be included in any of the examples described above, include (but are not limited to) the following:

1. A frac valve 40 may have a one-piece outer housing 42.

2. A frac valve 40 may comprise a sleeve 44 releasably secured in an outer housing 42, and in which the sleeve 44 displaces to a reduced dimension area 60 in the outer housing 42 in response to a pressure differential created across the sleeve 44. The sleeve 44 could displace to the reduced dimension area 60 in the outer housing 42 in response to a mechanically-applied displacing force (such as, applied via a mechanical shifting tool).

3. The reduced dimension area 60 may be spaced apart from the sleeve 44, so that ports 46 through the outer housing 42 previously blocked by the sleeve 44 are unblocked prior to the sleeve 44 entering the reduced dimension area 60.

4. The reduced dimension area 60 may have a smaller inner diameter than an outer diameter of the sleeve 44.

5. The reduced dimension area 60 may be internally tapered.

6. The reduced dimension area 60 may have an inner diameter that decreases in a direction of displacement of the sleeve 44 (as in the FIG. 5 example).

7. The reduced dimension area 60 may have projections 62 or ridges extending radially inward. In any of the above examples, the projections 62 or ridges could be formed externally on the sleeve 44.

8. The projections 62 or ridges may be deformed by the sleeve 44, or by the outer housing.

9. The reduced dimension area 60 may be internally threaded.

10. The sleeve 44 may be press-fit into the reduced dimension area 60.

11. The sleeve 44 may be secured in the reduced dimension area 60 by friction between the sleeve 44 and the reduced dimension area 60.

12. The sleeve 44 may be secured in the reduced dimension area 60 by plastic deformation of the outer housing 42.

13. The sleeve 44 may be secured in the reduced dimension area 60 by elastic deformation of the outer housing 42.

14. The sleeve 44 may be secured in the reduced dimension area 60 by elastic deformation of the sleeve 44.

15. The sleeve 44 may be secured in the reduced dimension area 60 by plastic deformation of the sleeve 44.

16. The sleeve 44 may be secured against rotation in the reduced dimension area 60 by engagement between the sleeve 44 and the reduced dimension area 60.

17. There may be no significant shoulder in the outer housing 42 to stop the sleeve 44 displacement.

18. A method described above may comprise opening a frac valve 22*a-c*, fracturing a formation zone 14*a-c* external to the open frac valve, and then flowing plugging devices to block openings 30 in the frac valve 22*a-c*.

19. Each of the plugging devices may include fibers, lines, ropes, yarns, fabrics, tubes, films or other appendages extending outwardly from at least one enlarged body, the body being too large to pass through the openings 30.

Note that it is not necessary that a frac valve incorporating the principles of this disclosure include any particular feature listed above. For example, it is not necessary that the frac valve 40 include a one-piece outer housing 42, since a multiple-piece housing could be used in other examples.

The above disclosure provides to the art a frac valve 40 for use in a subterranean well. In one example described above, the frac valve 40 can comprise an outer housing 42 with at least one port 30 which provides for fluid communication between an interior and an exterior of the outer housing 42, and a sleeve 44 releasably secured against displacement between a closed position in which the sleeve 44 blocks flow through the port 30 and an open position in which flow through the port 30 is permitted. In this example, the outer housing 42 is a single member having two end connections 58, each of the end connections 58 being configured to directly connect the outer housing 42 in a tubular string 16.

The outer housing 42 may comprise a reduced dimension area 60 in the interior of the outer housing 42. The sleeve 44 may be press-fit in the reduced dimension area 60 in the open position of the sleeve 44.

The sleeve 44 may be longitudinally spaced apart from the reduced dimension area 60 in the closed position of the sleeve 44. The reduced dimension area 60 may have an inner diameter D2 that is smaller than an outer diameter D1 of the sleeve 44.

The reduced dimension area 60 may be internally tapered, internally threaded and/or may comprise multiple inwardly extending projections 62. The reduced dimension area 60 may have an inner diameter D2 that decreases in a direction of displacement of the sleeve 44 between the closed and open positions.

Friction between the sleeve 44 and the reduced dimension area 60 may secure the sleeve 44 in the open position. Deformation of the sleeve 44 and/or deformation of the outer housing 42 may secure the sleeve 44 in the open position.

The sleeve 44 may be secured against rotation relative to the outer housing 42 in the open position of the sleeve 44. Deformation of the sleeve 44 and/or deformation of the outer housing 42 may prevent rotation of the sleeve 44 relative to the outer housing 42 in the open position of the sleeve 44.

The sleeve 44 may comprise a seat 54 configured to sealingly engage a plug 64 to thereby prevent flow through a flow passage 52 extending longitudinally through the outer housing 42.

Another frac valve 40 for use in a subterranean well is provided to the art by the above disclosure. In this example, the frac valve 40 can comprise an outer housing 42 with longitudinally spaced apart first and second inner dimensions (e.g., the inner diameter of the bore 56 and the inner dimension D2), the first inner dimension being larger in a lateral direction relative to the second inner dimension. The outer housing 42 can further comprise at least one port 46 which provides for fluid communication between an interior and an exterior of the outer housing 42. A sleeve 44 is releasably secured against displacement between a closed position in which the sleeve 44 blocks flow through the port 46 and an open position in which flow through the port 46 is permitted, and the sleeve 44 comprises an outer diameter D1 that is less than the first inner dimension (e.g., the inner diameter of the bore 56) and greater than the second inner dimension D2. The sleeve 44 is received in the first inner dimension in the closed position, and the sleeve 44 is received in the second inner dimension in the open position.

The sleeve 44 may be secured against longitudinal displacement relative to the outer housing 42 in the open position. The sleeve 44 may be secured against rotation relative to the outer housing 42 in the open position. The sleeve 44 may be press-fit in the second inner dimension D2 in the open position.

The second inner dimension D2 may be formed in a reduced inner dimension area 60 of the outer housing 42. The reduced inner dimension area 60 may be internally tapered, internally threaded, and/or may comprise at least one inwardly extending projection 62.

Friction between the sleeve 44 and the outer housing 42 may prevent relative rotation between the sleeve 44 and the outer housing 42 in the open position. Deformation of the sleeve 44 and/or deformation of the outer housing 42 may prevent relative rotation between the sleeve 44 and the outer housing 42 in the open position.

The outer housing 42 may comprise a single member having two end connections 58. Each of the end connections 58 may be configured to directly connect the outer housing 42 in a tubular string 16.

The sleeve 44 may comprise a seat 54 configured to sealingly engage a plug 64 to thereby prevent flow through a flow passage 52 extending longitudinally through the outer housing 42.

Also described above is a method of operating a frac valve 40 in a subterranean well. In one example, the method can comprise connecting the frac valve 40 in a tubular string 16, and displacing a sleeve 44 of the frac valve 40 between closed and open positions. The displacing step can include deforming at least one of the sleeve 44 and an outer housing 42 of the frac valve 40, thereby preventing relative rotation between the sleeve 44 and the outer housing 42.

The deforming step may include press-fitting the sleeve 44 into a reduced inner dimension area 60 of the outer housing 42.

The displacing step may include displacing the sleeve 44 from within a first inner dimension (e.g., the inner diameter of the bore 56) of the outer housing 42 into a second inner dimension D2 of the outer housing 42.

The sleeve 44 may comprise an outer diameter D1 that is less than the first inner dimension and is greater than the second inner dimension D2.

The deforming step may include deforming at least one projection 62. The projection 62 may extend inwardly into an interior of the outer housing 42. In other examples, the projection 62 may extend outwardly from an exterior of the sleeve 44. The deforming step may include deforming internal threads 68 in the outer housing 42.

The outer housing 42 may comprise at least one port 46 which provides for fluid communication between an interior and an exterior of the outer housing 42. The method may include plugging the port 46 after the sleeve 44 has displaced to the open position.

The connecting step may comprise connecting the outer housing 42 in the tubular string 16, an end connection 58 at each opposite end of a single member of the outer housing 42 being connected directly to the tubular string 16.

The displacing step may comprise applying a predetermined pressure differential across a plug 64 sealingly engaged with the sleeve 44.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only.

What is claimed is:

1. A frac valve for use in a subterranean well, the frac valve comprising:

an outer housing comprising at least one port which provides for fluid communication between an interior and an exterior of the outer housing; and a sleeve releasably secured against displacement between a closed position in which the sleeve blocks flow through the port and an open position in which flow through the port is permitted, in which the outer housing is a single member having two end connections, each of the end connections being configured to directly connect the outer housing in a tubular string, and in which an interference fit between the sleeve and the outer housing secures the sleeve in the open position.

2. The frac valve of claim 1, in which the outer housing comprises a reduced dimension area in the interior of the outer housing, and in which the sleeve is press-fit in the reduced dimension area in the open position of the sleeve.

3. The frac valve of claim 2, in which the sleeve is longitudinally spaced apart from the reduced dimension area in the closed position of the sleeve.

4. The frac valve of claim 2, in which the reduced dimension area has an inner diameter that is smaller than an outer diameter of the sleeve.

5. The frac valve of claim 2, in which the reduced dimension area is internally tapered.

6. The frac valve of claim 2, in which the reduced dimension area is internally threaded.

7. The frac valve of claim 2, in which the reduced dimension area comprises multiple inwardly extending projections.

8. The frac valve of claim 2, in which the reduced dimension area has an inner diameter that decreases in a direction of displacement of the sleeve between the closed and open positions.

9. The frac valve of claim 1, in which the outer housing comprises a reduced dimension area in the interior of the outer housing, and in which friction between the sleeve and the reduced dimension area secures the sleeve in the open position.

10. The frac valve of claim 1, in which the outer housing comprises a reduced dimension area in the interior of the outer housing, and in which deformation of the sleeve secures the sleeve in the open position.

11. The frac valve of claim 1, in which the outer housing comprises a reduced dimension area in the interior of the outer housing, and in which deformation of the outer housing secures the sleeve in the open position.

12. The frac valve of claim 1, in which the sleeve is secured against rotation relative to the outer housing in the open position of the sleeve.

13. The frac valve of claim 1, in which deformation of the sleeve prevents rotation of the sleeve relative to the outer housing in the open position of the sleeve.

14. The frac valve of claim 1, in which deformation of the outer housing prevents rotation of the sleeve relative to the outer housing in the open position of the sleeve.

15. The frac valve of claim 1, in which the sleeve comprises a seat configured to sealingly engage a plug to thereby prevent flow through a flow passage extending longitudinally through the outer housing.

16. A frac valve for use in a subterranean well, the frac valve comprising:

an outer housing comprising longitudinally spaced apart first and second inner dimensions, the first inner dimension being larger in a lateral direction relative to the second inner dimension, and the outer housing further comprising at least one port which provides for fluid communication between an interior and an exterior of the outer housing; and a sleeve releasably secured against displacement between a closed position in which the sleeve blocks flow through the port and an open position in which flow through the port is permitted, and the sleeve comprises an outer diameter that is less than the first inner dimension and greater than the second inner dimension, in which the outer diameter is received in the first inner dimension in the closed position, and the outer diameter is received in the second inner dimension in the open position.

17. The frac valve of claim 16, in which the sleeve is secured against longitudinal displacement relative to the outer housing in the open position.

18. The frac valve of claim 16, in which the sleeve is secured against rotation relative to the outer housing in the open position.

19. The frac valve of claim 16, in which the sleeve is press-fit in the second inner dimension in the open position.

20. The frac valve of claim 16, in which the second inner dimension is formed in a reduced inner dimension area of the outer housing, and in which the reduced inner dimension area is internally tapered.

21. The frac valve of claim 16, in which the second inner dimension is formed in a reduced inner dimension area of the outer housing, and in which the reduced inner dimension area is internally threaded.

22. The frac valve of claim 16, in which the second inner dimension is formed in a reduced inner dimension area of the outer housing, and in which the reduced inner dimension area comprises at least one inwardly extending projection.

23. The frac valve of claim 16, in which friction between the sleeve and the outer housing prevents relative rotation between the sleeve and the outer housing in the open position.

24. The frac valve of claim 16, in which deformation of the sleeve prevents relative rotation between the sleeve and the outer housing in the open position.

25. The frac valve of claim 16, in which deformation of the outer housing prevents relative rotation between the sleeve and the outer housing in the open position.

26. The frac valve of claim 16, in which the outer housing is a single member having two end connections, each of the end connections being configured to directly connect the outer housing in a tubular string.

27. The frac valve of claim 16, in which the sleeve comprises a seat configured to sealingly engage a plug to thereby prevent flow through a flow passage extending longitudinally through the outer housing.

* * * * *